US009740134B2

(12) United States Patent
Wada et al.

(10) Patent No.: US 9,740,134 B2
(45) Date of Patent: Aug. 22, 2017

(54) IMAGE FORMING APPARATUS THAT SETS SURFACE POTENTIAL OF PHOTORECEPTOR DRUM TO TARGET ELECTRIC POTENTIAL WITH SIMPLE CONFIGURATION

(71) Applicant: KYOCERA Document Solutions Inc., Osaka (JP)

(72) Inventors: Minoru Wada, Osaka (JP); Masaru Hatano, Osaka (JP); Masaki Kadota, Osaka (JP); Masahito Ishino, Osaka (JP); Keisuke Isoda, Osaka (JP); Atsushi Ishizaki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/346,142

(22) Filed: Nov. 8, 2016

(65) Prior Publication Data

US 2017/0146922 A1 May 25, 2017

(30) Foreign Application Priority Data

Nov. 19, 2015 (JP) ..... 2015-226177

(51) Int. Cl.
*G03G 15/02* (2006.01)
*G03G 15/043* (2006.01)
*G03G 15/00* (2006.01)

(52) U.S. Cl.
CPC ..... *G03G 15/0266* (2013.01); *G03G 15/043* (2013.01); *G03G 15/5058* (2013.01)

(58) Field of Classification Search
CPC ..... G03G 15/0266; G03G 15/043; G03G 15/5033; G03G 15/5041; G03G 15/5058
See application file for complete search history.

(56) References Cited

U.S. PATENT DOCUMENTS 6,006,047 A * 12/1999 Mara ..... G03G 15/5037 399/48
6,341,203 B1 * 1/2002 Nakazato ..... G03G 15/065 399/49
6,647,219 B2 * 11/2003 Buettner ..... G03G 15/5037 399/48

FOREIGN PATENT DOCUMENTS

JP 9-106142 A 4/1997

* cited by examiner

*Primary Examiner* — Hoang Ngo
(74) *Attorney, Agent, or Firm* — Stein IP, LLC

(57) ABSTRACT

An image forming apparatus includes an apparatus main body, a photoreceptor drum, a charging apparatus, an exposure apparatus, a developing device, a charging bias applying unit, a developing bias applying unit, an image condition adjusting unit, and a print density measurement unit. The image condition adjusting unit forms a second electric potential region by applying the charging bias where a first differential electric potential is subtracted from a first tentative charging bias on a circumference surface of a photoreceptor drum, and forms a second toner image by an electric potential difference between the second electric potential region and a developing roller by applying the target electric potential. The image condition adjusting unit decides value of the charging bias corresponding to the target electric potential from measurement results of print densities of a first toner image and the second toner image measured by the print density measurement unit.

13 Claims, 7 Drawing Sheets

IMAGE FORMING APPARATUS THAT SETS SURFACE POTENTIAL OF PHOTORECEPTOR DRUM TO TARGET ELECTRIC POTENTIAL WITH SIMPLE CONFIGURATION

INCORPORATION BY REFERENCE

This application is based upon, and claims the benefit of priority from, corresponding Japanese Patent Application No. 2015-226177 filed in the Japan Patent Office on Nov. 19, 2015, the entire contents of which are incorporated herein by reference.

BACKGROUND

Unless otherwise indicated herein, the description in this section is not prior art to the claims in this application and is not admitted to be prior art by inclusion in this section.

As a typical image forming apparatus employing an electrophotographic method such as a printer and a copier, there has been known an image forming apparatus that includes a photoreceptor drum, a charging apparatus, an exposure apparatus, a developing device, and a transfer apparatus. The charging apparatus uniformly charges a circumference surface of the photoreceptor drum. The exposure apparatus irradiates the photoreceptor drum with an exposure light according to image information to form an electrostatic latent image. The developing device supplies the photoreceptor drum with toner to develop the electrostatic latent image into a toner image. The transfer apparatus transfers the toner image from the photoreceptor drum to a sheet or an intermediate transfer belt.

To obtain good images, it is necessary for a surface potential of the photoreceptor drum in the image forming apparatus to be set to a desired electric potential. Especially, when the charging apparatus includes a charging roller that rotates while contacting a surface of the photoreceptor drum, even if a voltage applied to the charging roller is identical, the surface potential of the photoreceptor drum is likely to vary depending on an environmental variation or a similar factor. With the charging roller to which an ion conducting agent is combined, since a resistance value of the roller is likely to vary depending on the environment or a similar factor, a variation in electric potential of the photoreceptor drum is likely to be especially remarkable.

There has been proposed a typical image forming apparatus that includes a surface electrometer opposed to a circumference surface of a photoreceptor drum. Feeding back a measurement result of an electric potential by the surface electrometer to a voltage applied to a charging apparatus sets a surface potential of the photoreceptor drum to be a desired electric potential.

SUMMARY

An image forming apparatus according to one aspect of the disclosure includes an apparatus main body, a photoreceptor drum, a charging apparatus, an exposure apparatus, a developing device, a charging bias applying unit, a developing bias applying unit, an image condition adjusting unit, and a print density measurement unit. The photoreceptor drum has a circumference surface on which an electrostatic latent image including a background portion and an image portion is formed, the photoreceptor drum being rotationally driven in a predetermined rotation direction. The charging apparatus is arranged in contact with or close to the circumference surface of the photoreceptor drum. The charging apparatus charges the circumference surface at a predetermined electric potential. The exposure apparatus irradiates the circumference surface of the photoreceptor drum with an exposure light to form the electrostatic latent image. The circumference surface of the photoreceptor drum is charged at the predetermined electric potential. The developing device includes a developing roller opposed to the photoreceptor drum. The developing device supplies the photoreceptor drum with toner to develop the electrostatic latent image into a toner image. The charging bias applying unit applies a predetermined charging bias to the charging apparatus. The developing bias applying unit applies a predetermined developing bias to the developing roller. The image condition adjusting unit performs a charging bias adjusting operation. The charging bias adjusting operation adjusts an electric potential in the background portion in the electrostatic latent image on the photoreceptor drum to a predetermined target electric potential. The print density measurement unit measures a print density of the toner image. In the charging bias adjusting operation, the image condition adjusting unit forms a first electric potential region formed of a first electric potential by controlling the charging bias applying unit to charge the circumference surface of the photoreceptor drum to a first background-portion electric potential and then controlling the exposure apparatus to irradiate the circumference surface with the exposure light, and then forms a first toner image by an electric potential difference between the first electric potential region and the developing roller, by controlling the developing bias applying unit to apply the developing bias where a preliminarily set first differential electric potential is added to the first electric potential with respect to the developing roller. The image condition adjusting unit forms a second electric potential region by controlling the charging bias applying unit to apply the charging bias where the first differential electric potential is subtracted from a first tentative charging bias on the circumference surface of the photoreceptor drum. The first tentative charging bias is preliminarily set corresponding to the target electric potential, and then forms a second toner image by an electric potential difference between the second electric potential region and the developing roller by controlling the developing bias applying unit to apply the target electric potential to the developing roller. The image condition adjusting unit decides the value of the charging bias corresponding to the target electric potential from measurement results of print densities of the first toner image and the second toner image measured by the print density measurement unit.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
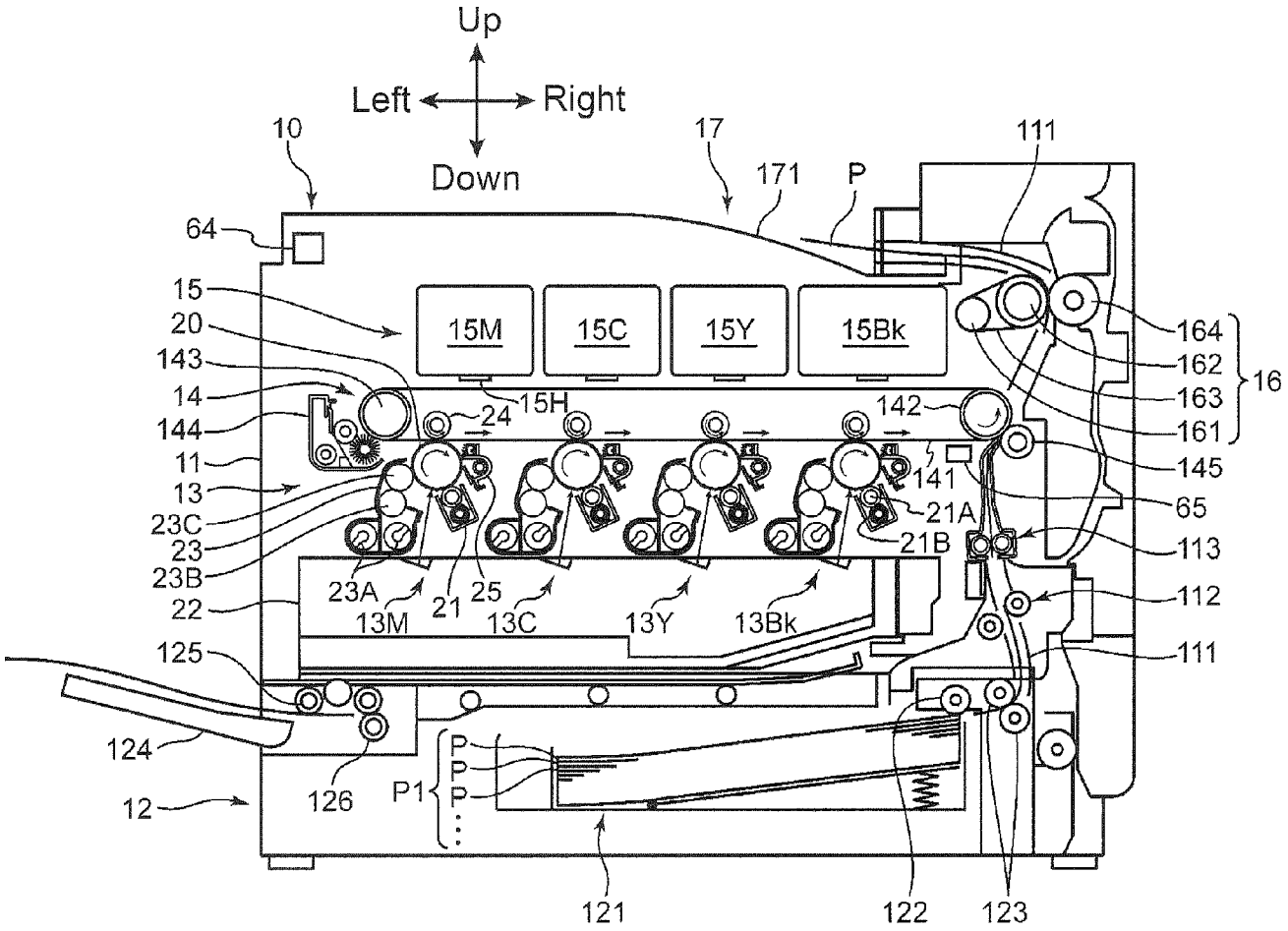
FIG. 1 illustrates a cross section of an internal structure of an image forming apparatus according to embodiments of the disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

The following describes an image forming apparatus 10 according to embodiments of the disclosure in detail with reference to the accompanying drawings. This embodiment exemplifies a tandem type color printer as an exemplary image forming apparatus. The image forming apparatus may be devices such as a copier, a facsimile device, and a multi-functional peripheral of these devices.

FIG. 1 illustrates a cross section of an internal structure of the image forming apparatus 10. This image forming apparatus 10 includes an apparatus main body 11 with a box-shaped chassis structure. This apparatus main body 11 internally includes a paper sheet feeder 12, which feeds a sheet P, an image forming unit 13, which forms a toner image to be transferred to the sheet P fed from the paper sheet feeder 12, an intermediate transfer unit 14 on which the toner image is primarily transferred, a secondary transfer roller 145, a toner replenishment unit 15, which replenishes the image forming unit 13 with toner, and a fixing unit 16, which fixes an unfixed toner image formed on the sheet P to the sheet P. Furthermore, at an upper portion of the apparatus main body 11, there is provided a paper sheet discharge unit 17 to which the sheet P fixed by the fixing unit 16 is discharged.

At an appropriate position on the top surface of the apparatus main body 11, an operation panel (not illustrated) for an input operation of an output condition or a similar operation to the sheet P is located. This operation panel includes a power key, a touch panel to input the output condition, and various operation keys. Additionally, the apparatus main body 11 internally includes a sheet conveyance path 111, which extends in a vertical direction, at a right side position of the image forming unit 13. The sheet conveyance path 111 includes a conveyance roller pair 112 to convey the sheet at an appropriate position. A registration roller pair 113 is arranged upstream with respect to a secondary transfer nip portion, which will be described later, in the sheet conveyance path 111. The registration roller pair 113 performs skew correction on the sheet and sends out the sheet to the nip portion at a predetermined timing. The sheet conveyance path 111 is a conveyance path that feeds the sheet P from the paper sheet feeder 12 to the paper sheet discharge unit 17 via the image forming unit 13 (the secondary transfer nip portion) and the fixing unit 16.

The paper sheet feeder 12 includes a sheet feed tray 121, a pickup roller 122, and a feed roller pair 123. The sheet feed tray 121 is insertably/removably mounted to a lower position of the apparatus main body 11 to store a sheet bundle P1, which is the plurality of stacked sheets P. The pickup roller 122 feeds out the sheet P on the uppermost surface of the sheet bundle P1 accumulated at the sheet feed tray 121 one by one. The feed roller pair 123 sends out the sheet P fed out by the pickup roller 122 to the sheet conveyance path 111. The paper sheet feeder 12 includes a manual paper feed tray, which is mounted to a left side surface of the apparatus main body 11 illustrated in FIG. 1. The manual paper feed tray includes a bypass tray 124, a pickup roller 125, and a feed roller pair 126. The bypass tray 124 is a tray on which the sheet P is manually placed. When the sheet P is manually fed, as illustrated in FIG. 1, the bypass tray 124 is opened from the side surface of the apparatus main body 11. The pickup roller 125 feeds out the sheet P placed on the bypass tray 124. The feed roller pair 126 sends out the sheet P fed out by the pickup roller 125 to the sheet conveyance path 111.

The image forming unit 13 forms a toner image to be transferred to the sheet P. The image forming unit 13 includes a plurality of image forming units, which form toner images of different colors. As this image forming unit, this embodiment includes a magenta unit 13M, which uses a magenta (M) color developer, a cyan unit 13C, which uses a cyan (C) color developer, a yellow unit 13Y, which uses a yellow (Y) color developer, and a black unit 13Bk, which uses a black (Bk) color developer, sequentially from upstream to downstream in a rotation direction of an intermediate transfer belt 141 (from the left side to the right side shown in FIG. 1). The units 13M, 13C, 13Y, and 13Bk each include a photoreceptor drum 20 (an image carrier), a charging apparatus 21, which is arranged at a peripheral area of the photoreceptor drum 20, a developing device 23, and a cleaning apparatus 25. An exposure apparatus 22 shared by the respective units 13M, 13C, 13Y, and 13Bk is arranged below the image forming unit.

The photoreceptor drum 20 is rotatably driven in a direction of the arrow in FIG. 1 (a predetermined rotation direction) around its axis, and an electrostatic latent image and a toner image are formed on a circumference surface of the photoreceptor drum 20. The electrostatic latent image formed on the photoreceptor drum 20 includes a background portion and an image portion according to image information. A rotation shaft of the photoreceptor drum 20 extends in a front-rear direction (a direction perpendicular to the paper surface of FIG. 1). As this photoreceptor drum 20, a photoreceptor drum using an organic photo conductor (OPC)-based material is applicable. As illustrated in FIG. 1, the plurality of photoreceptor drums 20 corresponding to the respective colors are arranged at predetermined intervals in a lateral direction (a horizontal direction).

The charging apparatus 21 uniformly charges the circumference surface of the photoreceptor drum 20 at a predetermined electric potential. As the charging apparatus 21, a charging apparatus with a contact electrification method can be employed. The charging apparatus 21 includes a charging roller 21A, which contacts the circumference surface of the photoreceptor drum 20 and is arranged and rotationally driven, and a charging cleaning brush 21 B to remove toner attached to the charging roller 21A. In another embodiment, the charging roller 21A may be arranged close to the circumference surface of the photoreceptor drum 20. The exposure apparatus 22 includes various optical system devices such as a light source, a polygon mirror, a reflection mirror, and a deflecting mirror. The exposure apparatus 22 irradiates the uniformly charged circumference surface of the photoreceptor drum 20 with light (exposure light) modulated based on image data to form the above-described electrostatic latent image. The cleaning apparatus 25 cleans the circumference surface of the photoreceptor drum 20 after the toner image transfer.

The developing device 23 supplies the circumference surface of the photoreceptor drum 20 with toner to develop the electrostatic latent image formed on the photoreceptor drum 20. The developing device 23 is for two-component developer constituted of toner and a carrier. The developing device 23 supplies the toner to the circumference surface of the photoreceptor drum 20 to develop the electrostatic latent image. The developing device 23 includes a developing roller 23C opposed to the photoreceptor drum 20, a magnetic roller 23B, and a pair of screws 23A. As the developing device 23, another constitution including the developing roller 23C may be applied. In this embodiment, the toner has a property that charges to a positive polarity.

The intermediate transfer unit 14 is located at the space between the image forming unit 13 and the toner replenishment unit 15. The intermediate transfer unit 14 includes the intermediate transfer belt 141, a drive roller 142, a tension roller 143, a plurality of primary transfer rollers 24, and a belt cleaning apparatus 144.

The intermediate transfer belt 141 is an endless belt-shaped rotator and is suspended across the drive roller 142 and the tension roller 143 such that its circumference surface side is brought into abutment with the circumference surfaces of the respective photoreceptor drums 20. The intermediate transfer belt 141 is circularly driven in one direction along the lateral direction and carries the toner image transferred from the plurality of photoreceptor drums 20 on its surface. The intermediate transfer belt 141 is a conductive soft belt with a laminated structure formed of a base layer, an elastic layer, and a coat layer.

The drive roller 142 stretches the intermediate transfer belt 141 at a right end side of the intermediate transfer unit 14 and causes the intermediate transfer belt 141 to circularly drive. The drive roller 142 is constituted of a metal roller. The tension roller 143 passively rotates at a left end side of the intermediate transfer unit 14. The tension roller 143 stretches the intermediate transfer belt 141. The tension roller 143 provides the intermediate transfer belt 141 with a tensile force. The belt cleaning apparatus 144 (see FIG. 1), which is located at the proximity of the tension roller 143, removes a remnant toner on the circumference surface of the intermediate transfer belt 141.

The primary transfer roller 24 is located across the intermediate transfer belt 141 and opposed to the photoreceptor drum 20. This forms primary transfer nip portions between the primary transfer rollers 24 and the photoreceptor drums 20 to primarily transfer the toner images, which are on the photoreceptor drums 20, on the intermediate transfer belt 141. As illustrated in FIG. 1, the respective primary transfer rollers 24 are opposed to the photoreceptor drums 20 for the respective colors. The primary transfer roller 24 is a roller extending in the front-rear direction and rotationally driven together with the intermediate transfer belt 141.

The secondary transfer roller 145 is opposed to the drive roller 142 across the intermediate transfer belt 141. The secondary transfer roller 145 is pressed and contacts the circumference surface of the intermediate transfer belt 141 to form the secondary transfer nip portion. The toner image primarily transferred on the intermediate transfer belt 141 is secondarily transferred on the sheet P supplied from the paper sheet feeder 12 at the secondary transfer nip portion. In this embodiment, the intermediate transfer unit 14 and the secondary transfer roller 145 constitute a transfer apparatus.

The toner replenishment unit 15 retains toner used for an image formation. The toner replenishment unit 15 according to the embodiment includes a magenta toner container 15M, a cyan toner container 15C, a yellow toner container 15Y, and a black toner container 15Bk. These toner containers 15M, 15C, 15Y, and 15Bk each retain replenishment toner for the respective colors M, C, Y, and Bk, and replenish the toners for the respective colors to the developing devices 23 for the image forming units 13M, 13C, 13Y, and 13Bk, which correspond to the respective colors M, C, Y, and Bk, from toner discharge ports 15H, which are formed on the bottom surfaces of the containers, via a toner conveying unit (not illustrated).

The fixing unit 16 includes a heating roller 161, which internally includes a heat source, a fixing roller 162, which is located opposed to the heating roller 161, a fixing belt 163, which is stretched between the fixing roller 162 and heating roller 161, and a pressure roller 164, which is located opposed to the fixing roller 162 via the fixing belt 163 and forms a fixing nip portion. The sheet P supplied to the fixing unit 16 passes through the fixing nip portion to be heated and pressurized. This fixies the toner image, which has been transferred to the sheet P at the secondary transfer nip portion, to the sheet P.

The paper sheet discharge unit 17 is formed by depressing the top of the apparatus main body 11. The bottom portion of this concave portion forms a sheet discharge tray 171 that receives the discharged sheet P. The sheet P on which the fixing process has been performed is discharged to the sheet discharge tray 171 via the sheet conveyance path 111 running from the upper portion of the fixing unit 16.

Figure 2:
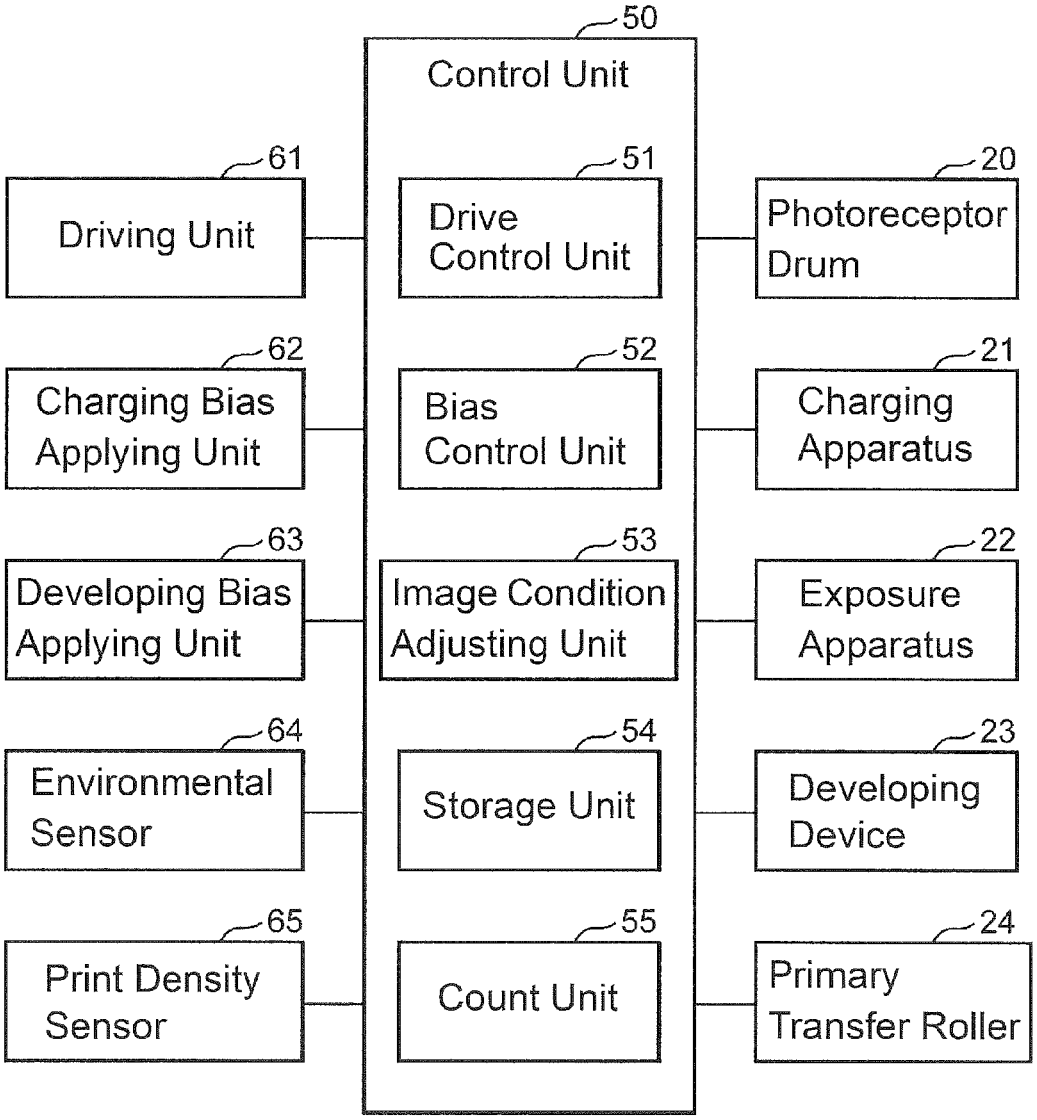
FIG. 2 illustrates an electrical block diagram of a control unit of the image forming apparatus according to the embodiments.

FIG. 2 illustrates an electrical block diagram of a control unit 50 of the image forming apparatus 10 according to the embodiment. The image forming apparatus 10 includes the control unit 50, which integrally controls the respective operations of this image forming apparatus 10. The control unit 50 is constituted of a Central Processing Unit (CPU), a Read Only Memory (ROM), which stores control programs, a Random Access Memory (RAM), which is used as a work area for the CPU, and a similar member. In addition to the above-described photoreceptor drum 20, charging apparatus 21, exposure apparatus 22, developing device 23, and primary transfer roller 24 of the image forming unit 13 and a similar member, the control unit 50 is electrically connected to a driving unit 61, a charging bias applying unit 62, a developing bias applying unit 63, an environmental sensor 64 (an environment detector), a print density sensor 65 (a print density measurement unit), and a similar member.

The driving unit 61 is formed of a gear mechanism that transmits a motor and a torque of the motor. The driving unit 61 rotates the respective members such as the image forming unit 13 and the secondary transfer roller 145 according to a control signal from a drive control unit 51, which will be described later.

The charging bias applying unit 62 is constituted of a DC power supply. Based on a control signal from a bias control unit 52, which will be described later, the charging bias applying unit 62 applies a predetermined charging bias to the charging roller 21A of the charging apparatus 21.

The developing bias applying unit 63 is constituted of a DC power supply and an AC power supply. Based on the control signal from the bias control unit 52, the developing bias applying unit 63 applies a predetermined developing bias to the developing roller 23C and the magnetic roller 23B of the developing device 23.

The environmental sensor 64 (see FIG. 1) is provided with the apparatus main body 11. The environmental sensor 64 detects temperature and humidity inside the apparatus main body 11. In another embodiment, the environmental sensor 64 may detect the temperature and humidity around the apparatus main body 11.

The print density sensor 65 (see FIG. 1) detects an image density of the toner image formed on the intermediate transfer belt 141 and converts the image density into an electric signal. The print density sensor 65 includes a light-emitting element, which emits light on a belt surface of the rotatably driven intermediate transfer belt 141, and a light receiving portion (not illustrated), which receives a reflected light from this belt surface. An image condition adjusting unit 53, which will be described later, refers to information on the image density output from the print density sensor 65, and the information is reflected to a charging bias adjusting operation and a calibration operation, which will be described later.

An execution of the control program stored in the ROM by the CPU causes the control unit 50 to function as the drive control unit 51, the bias control unit 52, the image condition adjusting unit 53, a storage unit 54, and a count unit 55.

The drive control unit 51 controls the driving unit 61 according to an image forming operation by the image forming apparatus 10, the charging bias adjusting operation, and the calibration operation, which will be described later. The drive control unit 51 controls a driving mechanism (not illustrated) as well as the driving unit 61 to drive other drive members in the image forming apparatus 10.

Similarly, the bias control unit 52 controls the charging bias applying unit 62 and the developing bias applying unit 63 according to the image forming operation by the image forming apparatus 10, the charging bias adjusting operation, and the calibration operation. The bias control unit 52 controls a bias applying unit (not illustrated) as well as the charging bias applying unit 62 and the developing bias applying unit 63 to apply a predetermined bias to other members inside the image forming apparatus 10. As one example, the bias control unit 52 applies a primary transfer bias and a secondary transfer bias to the primary transfer roller 24 and the secondary transfer roller 145, respectively.

The image condition adjusting unit 53 performs various image condition adjusting operations in the image forming apparatus 10. This image condition adjusting operation includes the charging bias adjusting operation. In the charging bias adjusting operation, the image condition adjusting unit 53 adjusts an electric potential at the background portion in the electrostatic latent image on the photoreceptor drum 20 to a predetermined target electric potential V0.

The storage unit 54 stores various pieces of reference information referred by the drive control unit 51, the bias control unit 52, and the image condition adjusting unit 53. As one example, the storage unit 54 stores electric potential information referred in the charging bias adjusting operation.

The count unit 55 counts various pieces of accumulated information in the image forming operation by the image forming apparatus 10 and the image condition adjusting operation. As one example, the count unit 55 counts the number of printed sheets to which the toner images are transferred, a printing interval period of the sheets (a period during which the image forming apparatus 10 is left), the number of accumulated rotations of the photoreceptor drum 20, and an accumulated application period of the charging bias by the charging apparatus 21.

<<Charging Bias Adjusting Operation>>

Figure 3:
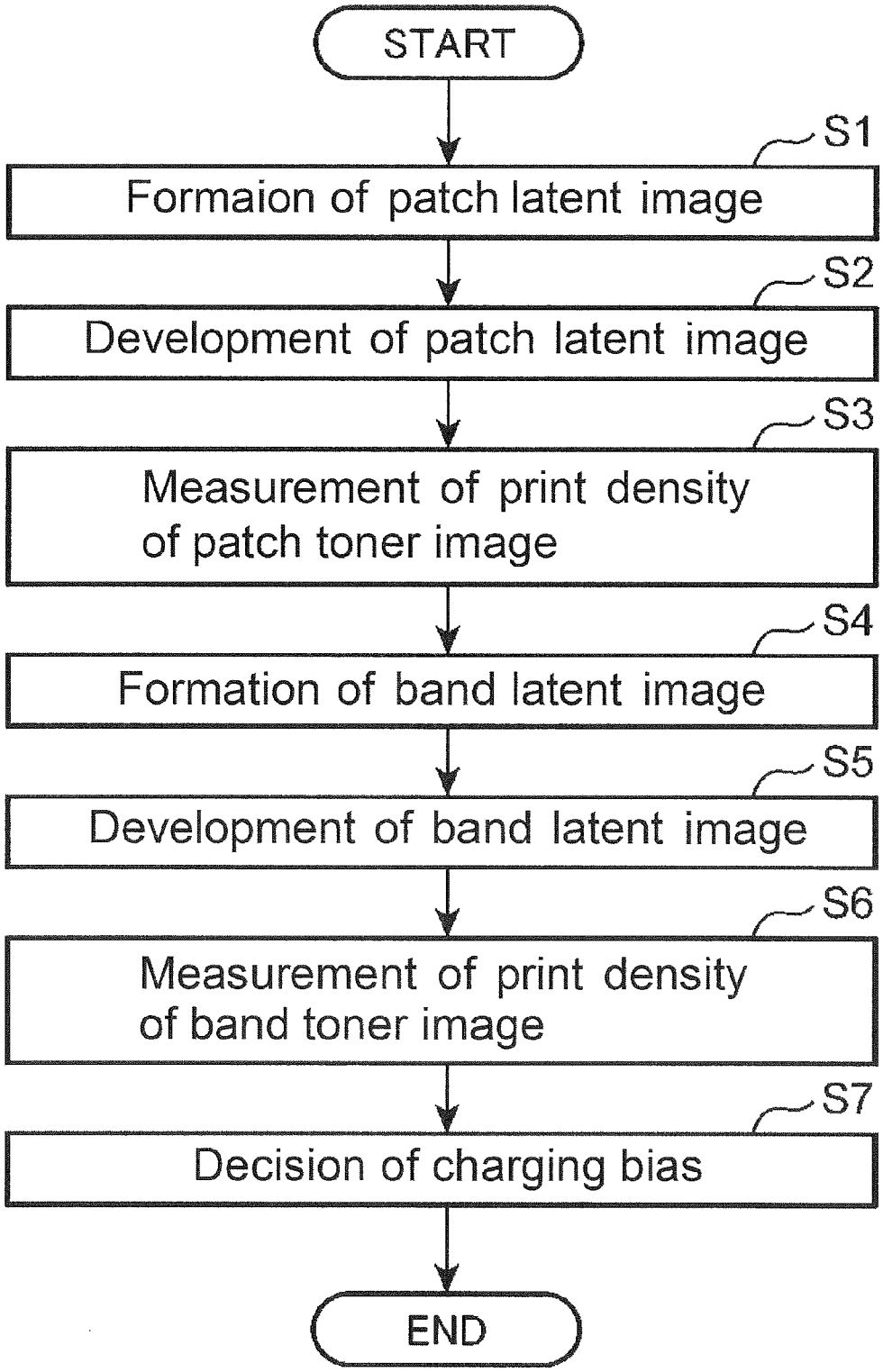
FIG. 3 illustrates a charging bias adjusting operation according to a first embodiment of the disclosure.
Figure 4:
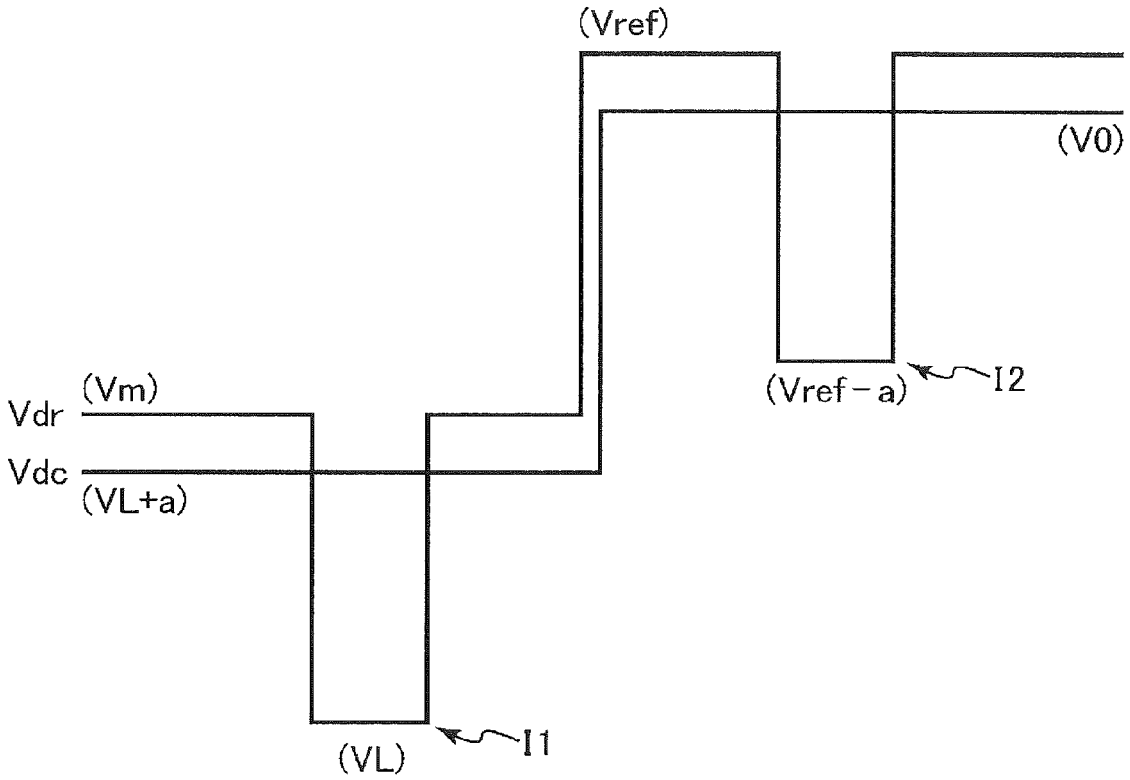
FIG. 4 schematically illustrates an electric potential relationship in the charging bias adjusting operation according to the first embodiment.

The following describes the charging bias adjusting operation according to a first embodiment of the disclosure. FIG. 3 illustrates the charging bias adjusting operation according to the embodiment. FIG. 4 schematically illustrates an electric potential relationship between the photoreceptor drum 20 and the developing roller 23C in the charging bias adjusting operation according to the embodiment. In FIG. 4, assume that a surface potential of the photoreceptor drum 20 is Vdr, and a DC bias potential of the developing roller 23C is Vdc. As described above, this embodiment includes the charging roller 21A, which contacts the circumference surface of the photoreceptor drum 20 and rotates. Especially in this embodiment, an ion conducting agent is combined in the charging roller 21A. Since a resistance value of such ion-conductive charging roller 21A has a property that is likely to change depending on an environmental condition such as a temperature and a humidity, it is difficult to hold the surface potential of the photoreceptor drum 20 constant. In such case, arranging a well-known surface electrometer opposed to the circumference surface of the photoreceptor drum 20 ensures performing a feedback control on the charging bias applied to the charging roller 21A based on a measurement result by the surface electrometer. However, this requires a space for locating an electrometer and causes a problem of cost increase in the image forming apparatus 10. To solve such problems, this embodiment does not include an electrometer, which measures the surface potential of the photoreceptor drum 20, but the image condition adjusting unit 53 performs the charging bias adjusting operation to accurately set the surface potential of the photoreceptor drum 20 to a target electric potential. This embodiment performs the charging bias adjusting operation in order on the photoreceptor drums 20 for the respective colors. In another embodiment, the charging bias adjusting operation may be concurrently performed on the photoreceptor drums 20 for a plurality of colors.

Referring to FIG. 3, the charging bias adjustment operation is constituted of seven steps as follows: formation of a patch latent image (Step S1); development of the patch latent image (Step S2); measurement of a print density of a patch toner image (Step S3); formation of a band latent image (Step S4); development of the band latent image (Step S5); measurement of a print density of a band toner image (Step S6); and decision of the charging bias (Step S7). The charging bias adjusting operation is roughly classified into three phases as follows: a first phase up to the measurement of the print density of the patch toner image (Step S3); a second phase up to the measurement of the print density of the band toner image (Step S6); and a third phase at the decision of the charging bias (Step S7). The timing of execution of the charging bias adjusting operation will be described in detail later.

The execution of the charging bias adjusting operation forms the patch latent image in FIG. 4 by the image condition adjusting unit 53 (Step S1). To form a good image by the image forming apparatus 10, a preset target electric potential at the background portion of the photoreceptor drum 20 is defined as V0 (V). As described above, this embodiment does not directly measure the surface potential of the photoreceptor drum 20 by, for example, the electrometer. Meanwhile, by controlling an input signal input from the bias control unit 52 to the charging bias applying unit 62, it is possible to control a value of the charging bias applied to the charging roller 21A by the charging bias applying unit 62 within a predetermined error range. In view of this, the charging bias adjusting operation derives the value of the charging bias such that the surface potential of the photoreceptor drum 20 becomes V0 (V). The storage unit 54 (see FIG. 2) preliminarily stores a value of a charging bias Vref. The charging bias Vref is a value derived preliminarily and experimentally such that the surface potential of the photoreceptor drum 20 becomes V0 (V). Even when this charging bias Vref is applied to the charging roller 21A of the charging apparatus 21, the surface potential of the photoreceptor drum 20 is not always set to V0 (V). This requires the above-described the charging bias adjusting operation.

At Step S1, the image condition adjusting unit 53 refers to an intermediate charging bias Vm preliminarily stored in the storage unit 54 (see FIG. 2), and controls the charging bias applying unit 62 to cause the intermediate charging bias Vm to be applied. The intermediate charging bias Vm is a bias value lower than the charging bias Vref in an absolute value. This results in charging the surface of the photoreceptor drum 20 to an intermediate electric potential (Vm), which is a first background-portion electric potential. The intermediate electric potential is settable with a certain degree of freedom. When a two-component development method is employed as a development method, a too high intermediate electric potential easily generates a carrier development due to an electric potential difference between a surface potential Vdr of the photoreceptor drum 20 and an electric potential Vdc (which is also referred to as developing bias) of the developing roller 23C. In view of this, the intermediate electric potential of the photoreceptor drum 20 is preferable to be a value around 50% of the target electric potential V0. When the two-component development method is not employed as the development method, similar to Step S4 described later, the photoreceptor drum 20 may be charged with the charging bias Vref.

When the surface potential Vdr at the background portion of the photoreceptor drum 20 becomes lower than the developing bias Vdc, a background-portion fog is generated and thus an error in a measurement of the print density at Step S3, which will be described later, is likely to occur. In view of this, the surface potential Vdr in the background portion of the photoreceptor drum 20 at Step 51 is preferable to be higher than the developing bias Vdc. Next, the image condition adjusting unit 53 controls the exposure apparatus 22 to irradiate the circumference surface of the photoreceptor drum 20 with the exposure light. At this time, the exposure apparatus 22 irradiates the circumference surface of the photoreceptor drum 20 with the exposure light corresponding to a 100%-solid image. These results in forming the patch latent image (a first electric potential region) formed of an image-portion electric potential VL (a first electric potential) on the circumference surface of the photoreceptor drum 20.

At Step S2, the development of the patch latent image is performed. The image condition adjusting unit 53 develops the patch latent image (the first electric potential region) formed at Step S1 by applying the developing bias Vdc (VL+a), where a preliminary set electric potential a (V) (a first differential electric potential) is added to the image-portion electric potential VL (V), with respect to the developing roller 23C by the control of the developing bias applying unit 63. This results in forming the patch toner image (I1 in FIG. 4), which is a first toner image, on the circumference surface of the photoreceptor drum 20 by the electric potential difference between the developing roller 23C, to which the developing bias Vdc of VL+a (V) is applied, and the patch latent image. In this embodiment, a is set to a=100 V, and the value of a is also preliminarily stored in the storage unit 54. A preferable range of the value of a is from 50 V to 200 V, and the more preferable range is from 100 V to 150 V. A plurality of levels of patch toner images may be formed with the value of a varied.

At Step S3, the print densities of the patch toner images formed at Step S2 is measured. The toner image on the photoreceptor drum 20 is transferred to the intermediate transfer belt 141 at a predetermined primary transfer bias applied to the primary transfer roller 24. The toner image carried on the intermediate transfer belt 141 passes through immediately above the print density sensor 65 in FIG. 1. In this respect, the print density sensor 65 measures the print density of the toner image. The storage unit 54 (see FIG. 2) stores the print density results of the respective toner images measured by the print density sensor 65.

At Step S4, the formation of band latent image is performed. Here, the image condition adjusting unit 53 controls the charging bias applying unit 62 to apply the charging bias Vref (a first tentative charging bias) to the charging roller 21A. At this phase, the surface potential of the photoreceptor drum 20 is likely to be set to the value deviated from the target electric potential V0. Further, the image condition adjusting unit 53 controls and causes the charging bias applying unit 62 to apply a value (Vref−a), where a (V) described above is subtracted from the charging bias Vref, for a predetermined time. This results in forming the band latent image (a second electric potential region) on the circumference surface of the photoreceptor drum 20, as illustrated in FIG. 4.

At Step S5, the development of the band latent image is performed. The image condition adjusting unit 53 sets the developing bias Vdc, which is applied to the developing roller 23C, to the target electric potential V0 (V) of the photoreceptor drum 20, and then develops the latent image (the band latent image) formed at Step S4. This results in forming the band toner image (I2 in FIG. 4), which is a second toner image, on the circumference surface of the photoreceptor drum 20 by the electric potential difference between the developing roller 23C, where the developing bias Vdc of V0 (V) is applied, and the band latent image (the second electric potential region).

At Step S6, the image condition adjusting unit 53 controls the print density sensor 65 to execute the measurement of print density of the band toner image formed at Step S5.

At Step S7, a print density D1 of the patch toner image measured at Step S3 and a print density D2 of the band toner image measured at Step S6 are compared, and then the charging bias Vref is corrected as necessary. As described above, the electric potential difference between the image-portion electric potential VL and the developing bias Vdc is a (V) at Step S1. In view of this, the print density D1 of the patch toner image is formed by movement of toner relative to the electric potential difference a (V) between the photoreceptor drum 20 and the developing roller 23C. At Step S4, when the charging bias Vref is applied, assuming that the surface potential Vdr of the photoreceptor drum 20 is set to the target electric potential V0 (V), the surface potential Vdr in the background portion of the photoreceptor drum 20 becomes identical to the electric potential of the developing roller 23C. In view of this, because the print density D2 of the band toner image is formed by movement of toner relative to the electric potential difference a (v), this results in the print density D1 equal to the print density D2.

On the other hand, when the print density D2 measured at Step S6 is larger than the print density D1, the surface potential Vdr in the background portion of the photoreceptor drum 20 at Step S4 is lower than the target electric potential V0. Consequently, in this case, the image condition adjusting unit 53 decides the value larger than the charging bias Vref as the charging bias relative to the target electric potential V0 (V). Specifically, applying the charging bias where a preliminarily set step value m (V) is added to the charging bias Vref to the photoreceptor drum 20 causes the processes from Step S4 to Step S6 to be executed again. Thus, while correcting the value of the charging bias, which is applied to the charging roller 21A, the image condition adjusting unit 53 extracts the charging bias where the print density D1 becomes equal to the print density D2. When the print density D2 measured at Step S6 is smaller than the print density D1, the image condition adjusting unit 53 decides the value lower than the charging bias Vref as the charging bias relative to the target electric potential V0 (V). This results in deciding the value of the charging bias corresponding to the target electric potential V0 of the photoreceptor drum 20. From Step S4 to Step S6, a plurality of levels of band toner images may be formed with the value of a (V) varied. In this case, the value of the charging bias that satisfies D1=D2 may be derived by performing linear regression for the relationship of the plurality of print densities D2 of the band toner images and each value of a. Further, after formation of one band and a plurality of patches, the charging bias corresponding to the target electric potential V0 may be derived by calculating of the electric potential difference of the band portion from these measurement results of the print densities.

As described above, in this embodiment, after charging the circumference surface of the photoreceptor drum 20 to the first background-portion electric potential (Vm) by the control of the charging bias applying unit 62, the image condition adjusting unit 53 forms the first electric potential region formed of the first electric potential (VL) by the control of the exposure apparatus 22 to irradiate the circumference surface of the photoreceptor drum 20 with the exposure light. Then, the image condition adjusting unit 53 forms the first toner image (I1), which is the patch toner image, with the electric potential difference between the first electric potential region and the developing roller 23C, by applying the developing bias, where the preliminarily set first differential electric potential (a) is added to the above-described first electric potential, with respect to the developing roller 23C by the control of the developing bias applying unit 63. Further, the image condition adjusting unit 53 forms the second electric potential region by applying a charging bias (Vref−a), where the above-described first differential electric potential is subtracted from the first tentative charging bias (Vref) that is preliminarily set corresponding to the target electric potential V0, on the circumference surface of the photoreceptor drum 20 by the control of the charging bias applying unit 62. Further, the image condition adjusting unit 53 forms the second toner image (I2), which is the band toner image, with the electric potential difference between the second electric potential region and the developing roller 23C, by applying the target electric potential V0 (V) to the developing roller 23C by the control of the developing bias applying unit 63. Subsequently, the image condition adjusting unit 53 decides the value of the charging bias corresponding to the target electric potential V0 from the measurement results of the print densities (D1, D2) of the patch toner image and the band toner image measured by the print density sensor 65. In view of this, a divergence amount of the charging bias Vref relative to the target electric potential V0 is determinable based on the relationship of the charging bias in the patch toner image and the print density of the toner image. This results in that the surface potential of the photoreceptor drum 20 becomes settable to a target electric potential with a simple configuration, without including a surface potential meter opposed to the photoreceptor drum 20.

In particular, in the charging bias adjusting operation, when the print density of the patch toner image is higher than the print density of the band toner image, the image condition adjusting unit 53 decides the value smaller than the charging bias Vref as the charging bias corresponding to the target electric potential V0. When the print density of the patch toner image is lower than the print density of the band toner image, the image condition adjusting unit 53 decides the value larger than the charging bias Vref as the charging bias corresponding to the target electric potential V0. In view of this, the charging bias corresponding to the target electric potential V0 is easily decidable from the print-density comparison result between the patch toner image and the band toner image.

In this embodiment, in the charging bias adjusting operation, the image condition adjusting unit 53 sets the background-portion electric potential in the front and rear in a rotation direction of the image-portion electric potential VL, by applying a predetermined intermediate charging bias Vm by the control of the charging bias applying unit 62. Then, the intermediate charging bias Vm is set to be smaller than the target electric potential V0. Thus, even when the two-component developer is used for the developing device, this prevents a lot of carriers from moving from the developing roller 23C to the photoreceptor drum 20 side, in the charging bias adjusting operation.

Further, in this embodiment, the exposure apparatus 22 forms the image-portion electric potential VL by irradiating the intermediate electric potential Vm with the exposure light corresponding to the 100%-solid image. Thus, this prevents the image-portion electric potential VL from being influenced by the intermediate electric potential Vm.

Figure 5:
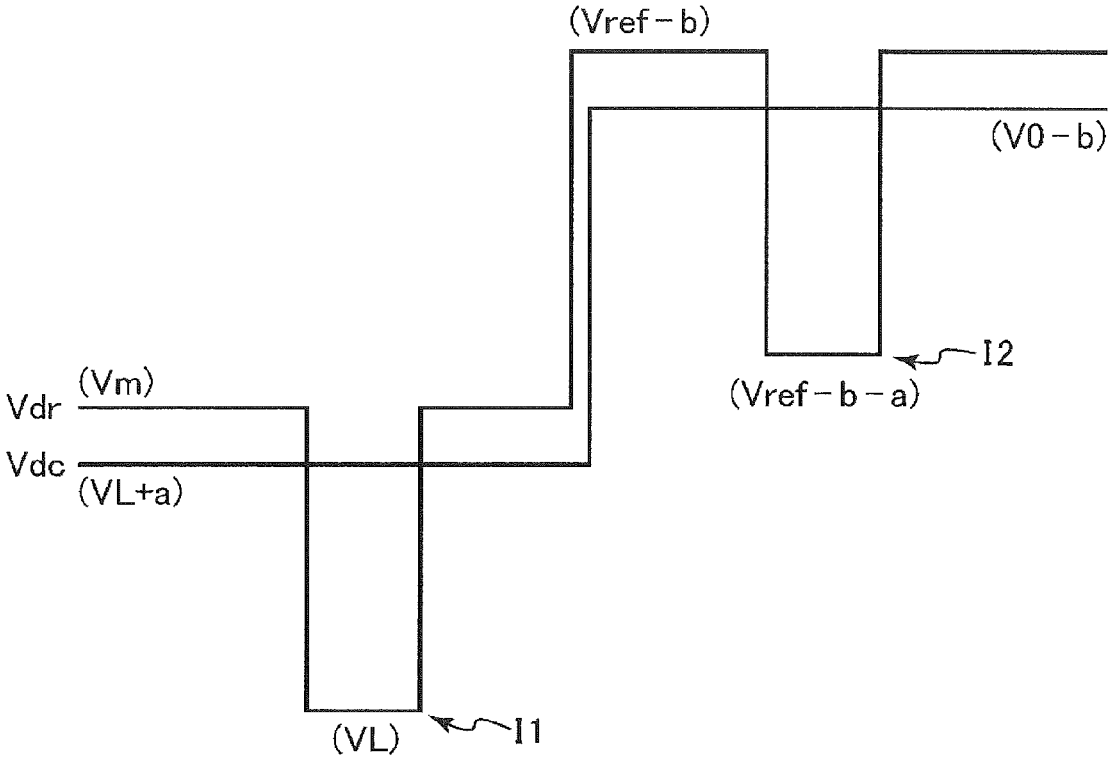
FIG. 5 schematically illustrates an electric potential relationship in the charging bias adjusting operation according to a second embodiment of the disclosure.

The following describes the charging bias adjusting operation according to a second embodiment of the disclosure. FIG. 5 schematically illustrates an electric potential relationship between the photoreceptor drum 20 and the developing roller 23C in the charging bias adjusting operation according to the embodiment. Compared with the above-described first embodiment, this embodiment partially differs from the formation of the band latent images at Step S4 to a decision of the charging bias at Step S7. Therefore, the following describes only these differences and omits descriptions on other common control aspects.

Referring to FIG. 5, of the charging bias adjusting operation, this embodiment specifically has a feature in the values of the surface potential Vdr of the photoreceptor drum 20 in the formation of the band latent image and the developing bias Vdc in the development of the band latent image. The values of the surface potential Vdr (Vm, VL) of the photoreceptor drum 20 in the formation and the development of the patch latent image and the value (VL+a) of the developing bias Vdc are identical to the first embodiment.

At Step S4 in FIG. 3, the image condition adjusting unit 53 sets the background-portion electric potential by applying the value (Vref−b), where b (V), which is a second differential electric potential, is subtracted from the preliminary set charging bias Vref (the first tentative charging bias), to the charging roller 21A by the control of the charging bias applying unit 62. Further, in the formation of the band latent image, the image condition adjusting unit 53 applies the value (Vref−b−a), where b (v) described above and a (V), which is the first differential electric potential, are subtracted from the charging bias Vref, to the charging roller 21A. This results in forming the band latent image on the photoreceptor drum 20. The value of b (V) is preliminarily set and is stored in the storage unit 54. Further, at Step S5 in FIG. 3, the image condition adjusting unit 53 controls the developing bias applying unit 63 to apply the value (V0−b), where only b (V) is subtracted from the target electric potential V0 of the photoreceptor drum 20, to the developing roller 23C. This results in forming the band toner image (I2 in FIG. 5) by the electric potential difference (V0−Vref+a) between the developing roller 23C and the band latent image. Consequently, similarly to the first embodiment, the image condition adjusting unit 53 ensures the decision of the charging bias corresponding to the target electric potential V0 with the comparison between the print density D1 and the print density D2.

In this embodiment, compared with the first embodiment, the developing bias applied by the developing bias applying unit 63 is decreased by b (V), at adjustment of the charging bias. Consequently, even when the developing bias Vdc is unsettable to the target electric potential V0 of the photoreceptor drum 20 due to an environment condition, restriction of a control range of a high-voltage power supply, or similar condition, this ensures the accurate setting of the target electric potential V0 of the photoreceptor drum 20. Therefore, this prevents the cost of the developing bias applying unit 63 constituted of the high-voltage power supply from increasing.

The following further describes this embodiment in detail with a working example. At Step S1 in FIG. 3, exposing the photoreceptor drum 20 charged to the intermediate electric potential Vm=250 V has formed a patch latent image (VL=100 V). Further, measuring the print density of the patch toner image, which has been developed by setting the developing bias Vdc to 250V (a=150 V), by the print density sensor 65 obtained the value of D1=0.52. Next, the circumference surface of the photoreceptor drum 20 was charged at 1400 V, where the second differential electric potential b=50 V was subtracted from the charging bias Vref=1450 V prepared corresponding to the target electric potential V0, and also a band latent image was formed at Vref−b−a=1250 V. Further, measuring the print density of the band toner image, which was developed by setting the developing bias to 500 V, where the second differential electric potential b=50 V was subtracted from the target electric potential V0=550 V, by the print density sensor 65 obtained the value of D2=0.42. Since the result was D1>D2, after a subtraction of 10 V from the charging bias Vref (1450 V), the charging bias 1440 V was selected as the bias value relative to the target electric potential V0 of the photoreceptor drum 20. For confirmation, the surface of the photoreceptor drum 20 charged with the charging bias 1440 V was measured by a surface potential meter for experiment, and the result was V0=560 V.

Next, the following describes the charging bias adjusting operation according to a third embodiment of the disclosure. In this embodiment, the development of the patch latent image at Step S2 is partially different compared with the above-described first embodiment. Therefore, the following describes only this difference and omits descriptions on the other common control aspects.

Similar to the above-described first embodiment, a patch latent image is formed also at Step S1 of this embodiment. In this case, the image condition adjusting unit 53 controls the exposure apparatus 22 to irradiate the circumference surface of the photoreceptor drum 20 with an exposure light corresponding to a 100%-solid image. This results in forming the patch latent image (the first electric potential region) formed of the image-portion electric potential VL (the first electric potential) on the circumference surface of the photoreceptor drum 20. However, the actual value of the image-portion electric potential VL is likely to contain an error due to a usage environment of the image forming apparatus 10 and a surface condition of the photoreceptor drum 20. In this embodiment, to correspond to such variations of the image-portion electric potential VL, the value of the developing bias Vdc, which is applied to the developing roller 23C, is corrected at Step S2.

Specifically, at Step S2, the image condition adjusting unit 53 calculates the value of VL of the developing bias Vdc (=VL+a) indicated in FIG. 5, which is applied to the developing roller 23C, from the following Formula 1 based on a preliminarily set reference VL (=VL0) and a correction value X.

$$VL=VL0+X \quad \text{(Formula 1)}$$

where, in this embodiment, VL0 is set to VL0=100V as one example. The correction value X is configured as the following Formula 2 from a correction value c that depends on the usage environment of the image forming apparatus 10 and a correction value d that depends on the operating time of the photoreceptor drum 20.

$$X=c+d \quad \text{(Formula 2).}$$

Table 1 indicates one example of the correction values c and d stored in the storage unit 54 (see FIG. 2).

TABLE 1

| | | Correction value d | | | | |
|---|---|---|---|---|---|---|
| Temperature (° C.) | Driving time (h) Correction value c | 0~500 0 | 500~1000 1 | 1000~1500 2 | 1500~2000 3 | 2000~2500 4 |
| 0 | 46 | 46 | 47 | 48 | 49 | 50 |
| 5 | 36 | 36 | 37 | 38 | 39 | 40 |
| 12 | 22 | 22 | 23 | 24 | 25 | 26 |
| 14 | 18 | 18 | 19 | 20 | 21 | 22 |
| 16 | 14 | 14 | 15 | 16 | 17 | 18 |
| 18 | 10 | 10 | 11 | 12 | 13 | 14 |
| 20 | 6 | 6 | 7 | 8 | 9 | 10 |
| 22 | 2 | 2 | 3 | 4 | 5 | 6 |
| 23 | 0 | 0 | 1 | 2 | 3 | 4 |

TABLE 1-continued

| Temperature (° C.) | Driving time (h) Correction value c | Correction value d 0~500 0 | 500~1000 1 | 1000~1500 2 | 1500~2000 3 | 2000~2500 4 |
|---|---|---|---|---|---|---|
| 24 | −2 | −2 | −1 | 0 | 1 | 2 |
| 26 | −6 | −6 | −5 | −4 | −3 | −2 |
| 28 | −10 | −10 | −9 | −8 | −7 | −6 |
| 30 | −14 | −14 | −13 | −12 | −11 | −10 |
| 32 | −18 | −18 | −17 | −16 | −15 | −14 |
| 40 | −34 | −34 | −33 | −32 | −31 | −30 |

In Table 1, the correction value c is set in a range of 46 (V) to −34 (V) with respect to a range of 0° C. to 40° C. in temperatures detected by the environmental sensor 64 (see FIG. 2). For the accumulated operating time (h) of the photoreceptor drum 20 counted by the count unit 55, the correction value d is classified in five ranges from a range 0 (0 hours to 500 hours) up to a range 4 (2000 hours to 2500 hours). Then, the correction value d is set in a range of 50 (V) to −34 (V). Storing such correction values in the storage unit 54 preliminarily and referencing to such correction values by the image condition adjusting unit 53 ensures bringing the electric potential difference for forming the patch latent image close to a (V) as much as possible even when variation of the image-portion electric potential VL occurs. The correction data for the image-portion electric potential VL in Table 1 may be used for correcting the value of the charging bias calculated at Step S7 in FIG. 3. In this case, in the charging bias adjusting operation, the image condition adjusting unit 53 decides the value of the charging bias corresponding to the target electric potential V0 from the measurement results of the print densities of the patch toner image (the first toner image) and the band toner image (the second toner image) measured by the print density sensor 65. Further, the image condition adjusting unit 53 corrects the value of the determined charging bias at Step S7 in FIG. 3 in response to the temperature or the humidity detected by the environmental sensor 64 and then decides the final value of the charging bias corresponding to the target electric potential V0. The same applies to the case where the image condition adjusting unit 53 corrects the value of the charging bias at Step S7 in FIG. 3, in response to the count result of the count unit 55.

Regarding the correction values c and d, the table value may be preliminarily stored in the storage unit 54 as described above, or the following calculating formula may be used.

$$c=2\times(23-T) \quad \text{(Formula 3)}$$

(T: the temperature (° C.) inside the detection unit of the image forming apparatus 10).

$$d=20\times t/10000 \quad \text{(Formula 4)}$$

(t: the accumulated operating time (h) of the photoreceptor drum 20).

Based on Formula 3 and Formula 4 described above, the developing bias VL+a, which is applied to the developing roller 23C, is set, and the patch latent image formed at Step 1 is developed. In this case also, in order for the print density sensor 65 to accurately detect the print density of the developed toner image, the range of the value of a is preferable to be from 50 V to 200 V, and is more preferable to be from 100 V to 150 V. A plurality of values of a may be set, and a plurality of levels of patch toner images may be formed.

As described above, in this embodiment, in the charging bias adjusting operation, the image condition adjusting unit 53 preliminarily corrects the value of the image-portion electric potential VL (the first electric potential) in response to the temperature detected by the environmental sensor 64, and then applies the developing bias, where the first differential electric potential (a) is added to the first electric potential (VL). The image condition adjusting unit 53 preliminarily corrects the value of the image-portion electric potential VL ((the first electric potential) in response to the count result of the count unit 55, and then applies the developing bias, where the first differential electric potential (a) is added to the first electric potential (VL). This configuration ensures preliminarily adjusting a variation amount of the first electric potential due to an ambient temperature variation and abrasion of the photoreceptor drum 20 when the photoreceptor drum 20 is irradiated with an identical amount of exposure light. In another modified embodiment, the image condition adjusting unit 53 may correct the first electric potential using the humidity (relative humidity) detected by the environmental sensor 64.

The following further describes this embodiment in detail with a working example. A patch latent image was obtained by exposing the photoreceptor drum 20, which has an accumulated operating time of 5000 hours at an environmental temperature of 10° C. and was charged to the intermediate electric potential Vm=250 V (Step S1 in FIG. 3). Then, in the condition of VL0=100 V, the corrected VL of VL=136 V was obtained by Formula 1 to Formula 4 described above. Subsequently, measuring the print density of the patch toner image, which was developed by setting the developing bias Vdc to 286 V (a=150 V), with the print density sensor 65 obtained D1=0.52. Next, the band latent image was formed with the condition of the charging bias Vref=1350 V, which was prepared corresponding to the target electric potential V0, and Vref−a=1200 V (the second electric potential region), and then measuring the print density of the band toner image, which was developed by setting the developing bias to the target electric potential V0=450 V of the photoreceptor drum 20, with the print density sensor 65 obtained D2=0.42. In this case, since the result was D1>D2, the charging bias Vref, which corresponds to the target electric potential V0, was corrected by subtraction of 10 V from the charging bias Vref and was set to 1340 V.

For confirmation, the surface of the photoreceptor drum 20 charged with the charging bias 1340 V was measured by a surface potential meter for experiment, and the result was V0=460 V.

<<Execution Timing of Charging Bias Adjusting Operation>>

The following describes the execution timing of the charging bias adjusting operation according to the above-described first, second, and third embodiments (hereinafter referred to as the embodiments). In the image forming apparatus 10, when the surface potential of the photoreceptor drum 20 varies, an image defect such as a print density variation occurs. Accordingly, it is preferable to perform the charging bias adjusting operation under conditions where the surface potential of the photoreceptor drum 20 is likely to vary from the target electric potential V0. The following describes the preferable conditions.

First, it is preferable that the charging bias adjusting operation is performed when the image forming apparatus 10 is left for a long time after a termination of the previous image forming operation. In this case, temperature and humidity environments inside and outside the image forming apparatus 10 or a similar factor may vary or the property of the charging roller 21A of the charging apparatus 21 may change. In the embodiments, the image forming apparatus 10 includes the count unit 55 (see FIG. 2). The count unit 55 operates a difference between an end time of the previous image forming operation and a request time of the next image forming operation. In other words, the count unit 55 counts a printing interval period between sheets. When the printing interval period by the count unit 55 exceeds a preset threshold stored in the storage unit 54, it is only necessary for the image condition adjusting unit 53 to perform the charging bias adjusting operation prior to the next image forming operation. This prevents the image defect in association with the variation of the surface potential of the photoreceptor drum 20 even if the unused image forming apparatus 10 is left over a long period of time.

Secondary, if the temperature and humidity inside and outside the machine of the image forming apparatus 10 largely change, the charging bias adjusting operation is preferably performed. In this case, due to the variation of the temperature and humidity environments, the property of the charging roller 21A of the charging apparatus 21 may change. In the embodiments, the image forming apparatus 10 includes the environmental sensor 64 (see FIG. 2). Accordingly, if the temperature or the humidity detected by the environmental sensor 64 exceeds the preset threshold, which is stored in the storage unit 54, it is only necessary for the image condition adjusting unit 53 to perform the charging bias adjusting operation prior to the next image forming operation. This prevents the image defect in association with the variation of the surface potential of the photoreceptor drum 20 even if the temperature and humidity inside and outside the machine of the image forming apparatus 10 largely change. A detection timing of the temperature and humidity by the environmental sensor 64 may be performed at constant time intervals. If the temperature and humidity when the previous charging bias adjusting operation has been performed are stored in the storage unit 54 and amounts of variation from these stored temperature and humidity are large, whether to perform the charging bias adjusting operation or not may be determined.

Thirdly, if the number of printed sheets printed within a predetermined period exceeds the preset threshold stored in the storage unit 54, the image condition adjusting unit 53 may perform the charging bias adjusting operation. Continuous executions of the image forming operation over a long time are likely to vary the surface potential of the photoreceptor drum 20 due to a temperature rise of the photoreceptor drum 20, the property change of the charging roller 21A, or a similar cause. Accordingly, with the large number of printed sheets within the predetermined time, accurately adjusting the surface potential V0 of the photoreceptor drum 20 prevents the image defect.

The above-described execution timing of the charging bias adjusting operation may be almost identical to a timing of the calibration operation (adjustments of developability, an amount of exposure, and out-of-color registration) performed by the image forming apparatus 10. In view of this, the image condition adjusting unit 53 may perform the charging bias adjusting operation simultaneous with the execution of the calibration operation. Next, the following describes a fourth embodiment of the disclosure that includes a charging bias control operation in such a series of calibration operations.

Figure 6:
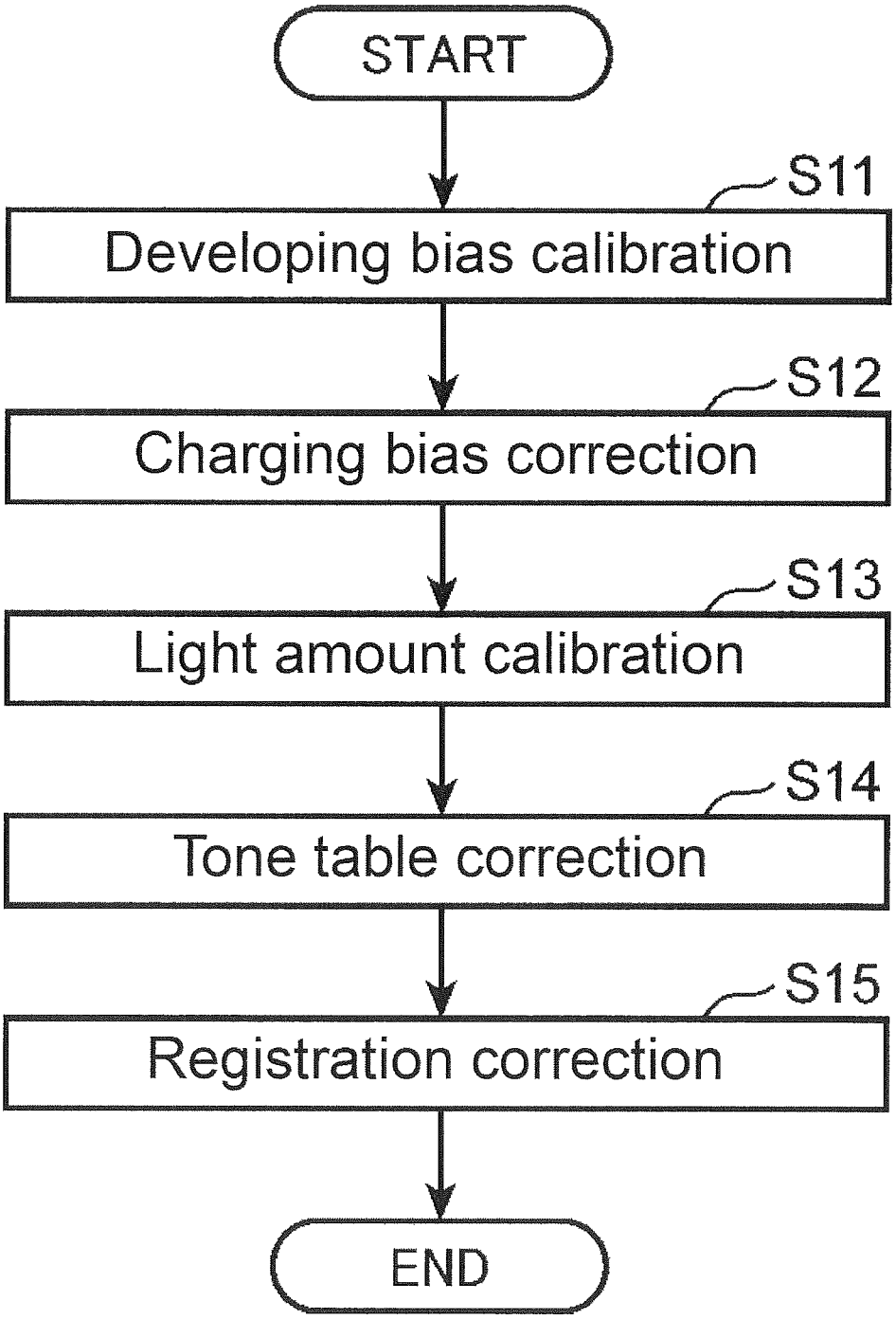
FIG. 6 illustrates a calibration operation including the charging bias adjustment operation according to a third embodiment of the disclosure.

FIG. 6 illustrates the calibration operation according to the embodiments. As one example, when the unused image forming apparatus 10 is left since the night on the previous day and a power supply of the image forming apparatus 10 is turned on in the morning of the next day, the image condition adjusting unit 53 performs the calibration operation in FIG. 6. The image condition adjusting unit 53 first performs a developing bias calibration (Step S11). In this calibration, to obtain the developing bias for obtaining a proper print density, the print densities of the 100%-solid patch and the halftone patch are measured with a plurality of levels of developing biases being set. Since slight deviation of the surface potential Vdr of the photoreceptor drum 20 causes no significant problems, such developing bias calibration is executable at the beginning of the whole calibration operation.

Next, the image condition adjusting unit 53 performs the charging bias adjusting operation (the correction of charging bias) according to the embodiment (Step S12). Afterwards, the image condition adjusting unit 53 performs a light amount calibration of the exposure apparatus 22 (Step S13). Here, an amount of laser light of the exposure apparatus 22 is adjusted to obtain an appropriate print density for a halftone image. Afterwards, the image condition adjusting unit 53 performs a tone table correction, which optimizes tone characteristics, (a print density tone adjustment calibration) (Step S14). Here, continuous tone print densities from a low print density area to a high print density area are adjusted. The light amount calibration and the tone table correction includes the final adjustment of the halftone image, and thus the surface potential Vdr of the photoreceptor drum 20 is required to be accurately set preliminarily. In view of this, the light amount calibration and the tone table correction are performed after the charging bias adjusting operation.

Afterwards, the image condition adjusting unit 53 performs a registration correction (Step S15). This adjusts an out-of-color registration of a full-color image or a similar defect. Here, to adjust out-of-color registration with a line image being formed, the halftone image is required to be accurately formed. In view of this, the registration correction is performed at the end of the series of calibration operation.

As described above, in this embodiment, the developing bias calibration operation is performed (Step S11) before the charging bias adjusting operation (Step S12). Then, the processes from the formation of the patch latent image in FIG. 3 (Step S1) to the measurement of the print density of the patch toner image (Step S3) uses a part of data of the developing bias calibration (Step S11 in FIG. 6) without executing inside the charging bias adjusting operation (Step S12 in FIG. 6). As described above, to derive the developing bias where a proper print density is obtained, the developing bias calibration measures the print density of a solid patch (first toner image) and a halftone patch while the value of the developing bias is varied in a plurality of levels. Consequently, the image condition adjusting unit 53 selects the developing bias that becomes a preferable value of a, among the plurality of levels of developing biases. This ensures obtaining the relationship of the electric potential difference a (V) and the print density D1 from the developing bias calibration. Thus, in this embodiment, omitting the time from the formation of the patch latent image in FIG. 3 (Step S1) to the measurement of the print density of the patch toner image (Step S3) ensures the reduced time required for the charging bias adjusting operation to about a half. In another modified embodiment, the control after Step S4 in FIG. 3 may be executed concomitantly with the series of the calibration operations at a necessary timing. This ensures smooth-flowing execution of the whole calibration operation and obtainment of the target surface potential V0 for the photoreceptor drum 20.

Furthermore, in this embodiment, the image condition adjusting unit 53 performs the charging bias adjusting operation (Step S12), and then the calibration operation (Step S14), which adjusts the print density tone of the toner image, is performed. Accordingly, the print density tone of the toner image is adjusted with the surface potential V0 of the photoreceptor drum 20 stably held. This ensures obtaining a stable image quality in the subsequent image forming operation.

The formation of the patch toner image (the first toner image) and the measurement of the print density of the patch toner image by the print density sensor 65 in the development calibration operation may be performed on the plurality of patch toner images, where the values of the image-portion electric potentials VL (the first electric potentials) are different with one another. This ensures accurate detection of the relationship of the charging bias in the patch toner image and the print density of the patch toner image. This ensures accurate setting of the surface potential of the photoreceptor drum 20 to the target electric potential V0.

The following further describes this embodiment in detail with a working example. At Step S1 in FIG. 3, exposing the photoreceptor drum 20 charged to the intermediate electric potential Vm=250 V formed a patch latent image (VL=100 V). Further, measuring the print density of the patch toner image, which was developed by setting the developing bias Vdc to 250 V (a=150 V), by the print density sensor 65 obtained the value of D1=0.52. Subsequently, the circumference surface of the photoreceptor drum 20 was charged with the charging bias Vref=1350 V of the target electric potential V0, and then a band latent image was formed with Vref−a=1200 V. Further, measuring the print density of the band toner image, which was developed by setting the developing bias to the target electric potential V0=450 V, by the print density sensor 65 obtained the value of D2=0.42. Since the result was D1>D2, after subtraction of 10 V from the charging bias Vref (1350 V), the charging bias 1340 V was selected as the bias value relative to the target electric potential V0 of the photoreceptor drum 20. For confirmation, the surface of the photoreceptor drum 20 charged by the charging bias 1340 V was measured by a surface potential meter for experiment, and the result was V0=460 V.

Next, the charging bias adjusting operation according to a fifth embodiment of the disclosure will be described. In this embodiment, the decision of the charging bias at Step S7 (see FIG. 3) is partially different compared with the above-described first embodiment. Therefore, the following describes only this difference and omits descriptions on the other common control aspects.

In this embodiment also, similar to the above-described fourth embodiment, the developing bias calibration is performed prior to the charging bias adjusting operation. On the other hand, in this embodiment, similar to the above-described first embodiment, the processes from the formation of the patch latent image in FIG. 3 (Step S1) up to the decision of the charging bias (Step S7) are executed. Then, the final process of the decision of the charging bias (Step S7) appropriately refers to the data obtained in the developing bias calibration.

Table 2 indicates the relationship of the value of the developing bias Vdc obtained in the developing bias calibration and the print density (ID) of the 100%-solid patch toner image. In this case, the image-portion electric potential VL of the photoreceptor drum 20 is set to 100 V. In the table 2, the electric potential difference a (V) between the developing roller 23C and the image-portion electric potential VL is calculated at each level.

TABLE 2

| | Vdc (V) | a (V) | ID |
|---|---|---|---|
| Level 1 | 200 | 100 | 0.27 |
| Level 2 | 300 | 200 | 0.77 |
| Level 3 | 400 | 300 | 1.23 |
| Level 4 | 500 | 400 | 1.54 |

Figure 7:
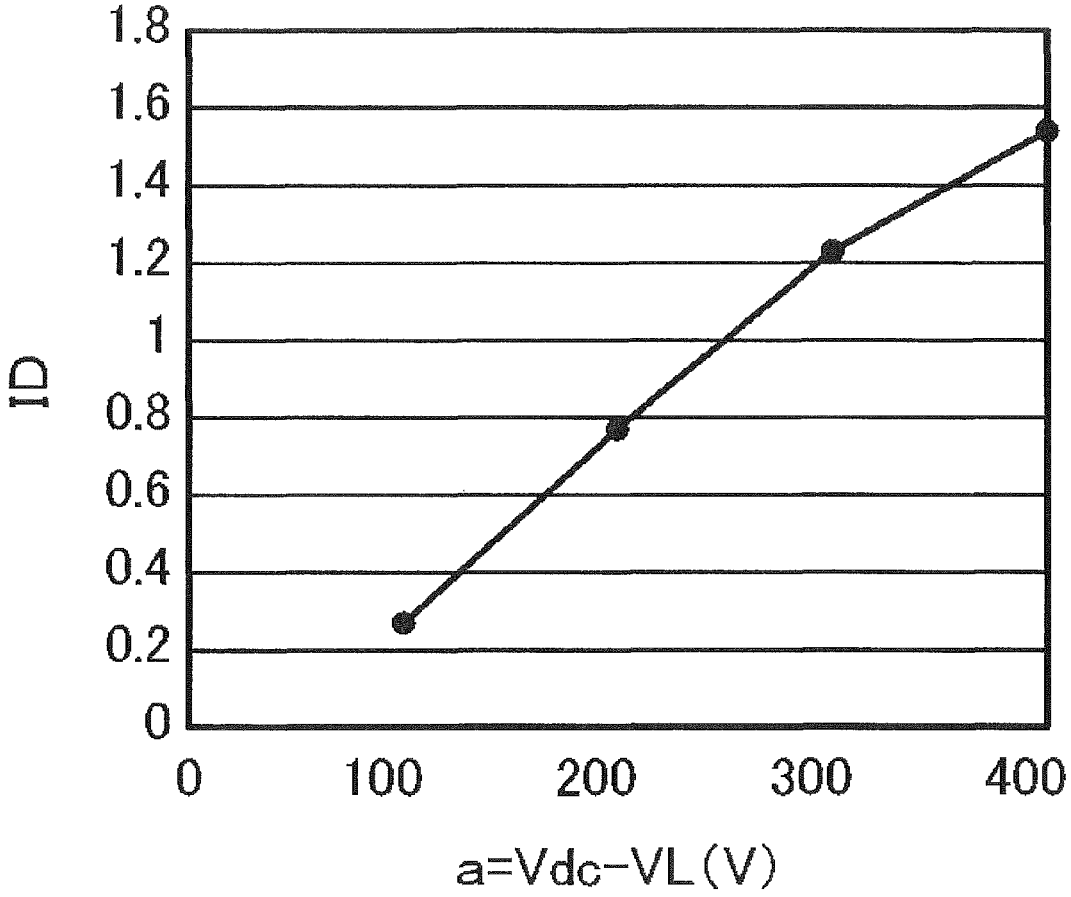
FIG. 7 illustrates a relationship of an electric potential difference between a photoreceptor drum and a developing roller and a print density of a toner image obtained by the calibration operation according to a fifth embodiment of the disclosure.

FIG. 7 illustrates the relationship of the electric potential difference a (V) and the print density (ID) in Table 2. Here, performing linear regression of the data of the level 1 and the level 2 in FIG. 7 obtains the following Formula 5.

$$D=0.005\ V+X \quad \text{(Formula 5)}$$

(D: print density ID, V: the electric potential difference a, X: y-intercept in FIG. 7). The image condition adjusting unit 53 converts the print density difference between the print density D1 and the print density D2, which was obtained in the decision process of the charging bias in FIG. 3 (Step S7), to an electric potential difference by referring to Formula 5 described above. Subsequently, correcting the charging bias Vref with this electric potential difference ensures promptly deriving the value of the charging bias corresponding to the target electric potential V0 of the photoreceptor drum 20. Therefore, this ensures obtaining an appropriate amount of correction of the charging bias Vref without forming a plurality of levels of patch toner images and band toner images.

The following further describes this embodiment in detail with a working example. At Step S1 in FIG. 3, exposing the photoreceptor drum 20 charged to the intermediate electric potential Vm=250 V formed a patch latent image (VL=100 V). Further, measuring the print density of the patch toner image, which was developed by setting the developing bias Vdc to 250 V (a=150 V), by the print density sensor 65 obtained the value of D1=0.52. Subsequently, a band latent image was formed with the charging bias Vref=1350 V of the target electric potential V0 and Vref−a=1200 V. Further, measuring the print density of the band toner image, which was developed by setting the developing bias to the target electric potential V0 (450 V), by the print density sensor 65 obtained the value of D2=0.42. Since the relationship of the print density and the developing bias (Formula 5) is obtained from the data of the development calibration, the print density difference of D1−D2=0.1 is converted to the electric potential difference of 20 V. Consequently, the charging bias Vref was corrected to 1330 V by subtracting 20 V from the charging bias Vref. For confirmation, the surface of the photoreceptor drum 20 charged by the charging bias 1330 V was measured by the surface potential meter for experiment, and the result was V0=450 V.

Correction of Charging Bias Vref

The following describes a sixth embodiment of the disclosure. Compared with the above-described first and second embodiments, this embodiment differs in predictive control of the charging bias Vref. Therefore, the following describes only this difference and omits descriptions on other common control aspects. Vref, which is used in the charging bias adjusting operation, is preferably a value that can accurately reproduce the target surface potential V0 for the photoreceptor drum 20. However, the charging bias Vref required to reproduce the identical target electric potential V0 is likely to largely change due to the environment (the temperature and humidity), a period of using the photoreceptor drum 20 (a degree of deterioration of a surface layer of the photoreceptor drum 20), or a similar factor. In view of this, in this embodiment, the image condition adjusting unit 53 corrects the value of the charging bias Vref (the first tentative charging bias) according to a predetermined correction condition prior to the charging bias adjusting operation (see FIG. 3).

Table 3 shows an amount of correction of the charging bias Vref corrected by the image condition adjusting unit 53 when the temperature and the humidity detected by the environmental sensor 64 change. The storage unit 54 preliminary stores this amount of correction. As one example, with the detected temperature and humidity at 18 degrees and 30% RH, a value found by adding 76 V to a predetermined reference value is set as the charging bias Vref, and the charging bias adjusting operation is started. With this correction, even if the properties of the photoreceptor drum 20 and the charging apparatus 21 change according to the temperature and humidity, the adjusting operation is performed in the electric potential area close to the actual target electric potential V0. Therefore, the charging bias adjusting operation is quickly and accurately achieved.

TABLE 3

| | | Temperature (T ° C.) | | | | | | | | | | | | | | |
|---|---|---|---|---|---|---|---|---|---|---|---|---|---|---|---|---|
| | | 0 | 5 | 12 | 14 | 16 | 18 | 20 | 22 | 23 | 24 | 26 | 28 | 30 | 32 | 40 |
| Humidity (H %) | 15% | 346 | 274 | 180 | 161 | 139 | 118 | 114 | 111 | 109 | 100 | 80 | 61 | 48 | 31 | −24 |
| | 20% | 337 | 265 | 173 | 150 | 127 | 104 | 98 | 93 | 90 | 81 | 62 | 44 | 31 | 16 | −31 |
| | 25% | 328 | 257 | 166 | 139 | 115 | 90 | 82 | 74 | 71 | 52 | 44 | 27 | 15 | 1 | −37 |
| | 30% | 319 | 248 | 159 | 129 | 102 | 76 | 66 | 56 | 51 | 43 | 26 | 10 | −2 | −14 | −43 |
| | 35% | 313 | 242 | 152 | 122 | 94 | 66 | 55 | 44 | 39 | 31 | 15 | 0 | −10 | −20 | −44 |
| | 40% | 307 | 236 | 146 | 115 | 86 | 57 | 44 | 32 | 26 | 18 | 4 | −10 | −18 | −26 | −45 |
| | 45% | 301 | 230 | 139 | 108 | 77 | 47 | 34 | 20 | 13 | 6 | −7 | −20 | −26 | −32 | −46 |
| | 50% | 295 | 224 | 132 | 100 | 69 | 38 | 23 | 8 | 0 | −6 | −18 | −31 | −35 | −39 | −47 |
| | 55% | 291 | 220 | 128 | 96 | 64 | 32 | 18 | 4 | −3 | −9 | −20 | −31 | −35 | −39 | −47 |
| | 60% | 287 | 216 | 124 | 91 | 58 | 26 | 13 | 0 | −6 | −11 | −21 | −32 | −35 | −39 | −47 |
| | 65% | 233 | 212 | 120 | 86 | 53 | 19 | 8 | −3 | −9 | −14 | −23 | −32 | −35 | −40 | −47 |
| | 70% | 279 | 208 | 116 | 32 | 47 | 13 | 3 | −7 | −12 | −16 | −24 | −33 | −36 | −40 | −47 |
| | 75% | 275 | 204 | 112 | 77 | 42 | 7 | −2 | −10 | −15 | −19 | −26 | −33 | −36 | −41 | −47 |
| | 80% | 271 | 200 | 108 | 72 | 37 | 1 | −7 | −14 | −18 | −21 | −28 | −34 | −36 | −41 | −47 |

Table 4 shows an amount of correction of the charging bias Vref corrected by the image condition adjusting unit 53 according to an accumulated driving period of the photoreceptor drum 20 detected by the count unit 55. The storage unit 54 preliminary stores this amount of correction. As one example, with the detected driving period of the photoreceptor drum 20 of 50 hours, a value found by adding 50 V to a predetermined reference value is set as the charging bias Vref and the charging bias adjusting operation is started. In this case, even if the charging characteristic of the photoreceptor drum 20 changes according to the driving period of the photoreceptor drum 20, the charging bias adjusting operation is quickly and accurately achieved. In another modified embodiment, the count unit 55 may count an accumulated application period of the charging bias by the charging apparatus 21. It is only necessary that the storage unit 54 preliminary stores correction values shown in Table 4 according to the accumulated application period of the charging bias. In this case as well, even if the charging characteristic of the charging roller 21A changes according to the accumulated application period of the charging bias, the charging bias adjusting operation is quickly and accurately achieved. With the above-described respective amounts of correction in combination with one another, the charging bias Vref may be adjusted by the temperature and humidity inside and outside the machine of the image forming apparatus 10, the driving period of the photoreceptor drum 20, and a similar factor. The charging bias Vref may be adjusted according to other correction conditions. The above-described respective correction values may be stored not as a table but as a predetermined correction formula. After the above-described charging bias Vref is corrected, the charging bias adjusting operation similar to the above-described first or second embodiment is performed.

TABLE 4

| | | | | | | | | | |
|---|---|---|---|---|---|---|---|---|---|
| Photoreceptor driving time [Time] | 0 | 10 | 20 | 30 | 40 | 50 | 60 | 500 | 1000 |
| Amount of Vref correction [V] | 0 | 10 | 20 | 30 | 40 | 50 | 60 | 60 | 50 |

The image forming apparatus 10 according to the embodiments of the disclosure is described above in detail; however, the disclosure is not limited to this. The disclosure can employ, for example, the following modified embodiments.

(1) The above-described respective embodiments describe the aspect that the toner is charged to a positive polarity; however, the disclosure is not limited to this. When the toner is charged to a negative polarity, the similar charging bias adjustment control is executable with polarities of the above-described respective biases inverted.

(2) The above-described embodiments describe the aspect that the image forming apparatus 10 is the full-color image forming apparatus; however, the disclosure is not limited to this. The image forming apparatus 10 may be a monochrome printer or a similar printer that forms a single color image.

(3) The above-described first embodiment describes the aspect where one band latent image (band toner image) is formed from Step S4 to Step S6 in FIG. 3; however, the disclosure is not limited to this aspect. In another embodiment, a plurality of band latent images may be formed by varying the value of a, in the right-side electric potential relationship in FIG. 4. This ensures that the image condition adjusting unit 53 accurately detects the difference between the charging bias Vref and the target electric potential V0 from the measurement results of the print densities of the plurality of band toner images.

(4) The above-described first embodiment describes the aspect where, in the developing bias Vdc, which is applied to the developing roller 23C when the patch toner image is formed, the value of a (V), which is added to the image-portion electric potential VL, is identical to the electric potential difference a (V), which is subtracted from the charging bias Vref when the band toner image is formed; however, the disclosure is not limited to this aspect. Both values do not have to be identical. When the different values are applied, it is only necessary to correct the value of the derived charging bias by the difference of both values, at Step S7 in FIG. 3.

(5) The above-described first embodiment describes the aspect where the image-portion electric potential VL is formed by the exposure light corresponding to the 100%-solid patch; however, the disclosure is not limited to this aspect. A surface potential V1 may be set instead of the image-portion electric potential VL. In this case, the value of V1 is settable to 0 V. The surface potential V1 is preferable to be −50 V to 150 V, and is more preferable to be 0 V to 100 V. In particular, when the surface potential V1 is set to 0 V, it is only necessary to set the developing bias Vdc to a (V). This ensures stable formation of the patch toner image (the first toner image) in response to the electric potential difference a (V), which is the first differential electric potential.

(6) The fourth embodiment described above describes the aspect where the developing bias calibration operation is performed (Step S11) prior to the charging bias adjusting operation (Step S12) in FIG. 6; however, the disclosure is not limited to this aspect. Namely, preliminarily as a part of the charging bias adjusting operation, a band toner image may be formed, and then the print density of this band toner image may be measured. Subsequently, during the calibration operation performed afterward, the charging bias may be calculated based on the measured print density of the band toner image.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An image forming apparatus comprising:

an apparatus main body;

a photoreceptor drum that has a circumference surface on which an electrostatic latent image including a background portion and an image portion is formed, the photoreceptor drum being rotationally driven in a predetermined rotation direction;

a charging apparatus arranged in contact with or close to the circumference surface of the photoreceptor drum, the charging apparatus charging the circumference surface at a predetermined electric potential;

an exposure apparatus that irradiates the circumference surface of the photoreceptor drum with an exposure light to form the electrostatic latent image, the circumference surface of the photoreceptor drum being charged at the predetermined electric potential;

a developing device that includes a developing roller opposed to the photoreceptor drum, the developing device supplying the photoreceptor drum with toner to develop the electrostatic latent image into a toner image;

a charging bias applying unit that applies a predetermined charging bias to the charging apparatus;

a developing bias applying unit that applies a predetermined developing bias to the developing roller;

an image condition adjusting unit that performs a charging bias adjusting operation, the charging bias adjusting operation adjusting an electric potential in the background portion in the electrostatic latent image on the photoreceptor drum to a predetermined target electric potential; and a print density measurement unit that measures a print density of the toner image, wherein, in the charging bias adjusting operation, the image condition adjusting unit forms a first electric potential region formed of a first electric potential by controlling the charging bias applying unit to charge the circumference surface of the photoreceptor drum to a first background-portion electric potential and then controlling the exposure apparatus to irradiate the circumference surface with the exposure light, and then forms a first toner image by an electric potential difference between the first electric potential region and the developing roller, by controlling the developing bias applying unit to apply the developing bias where a preliminarily set first differential electric potential is added to the first electric potential with respect to the developing roller, and the image condition adjusting unit forms a second electric potential region by controlling the charging bias applying unit to apply the charging bias where the first differential electric potential is subtracted from a first tentative charging bias on the circumference surface of the photoreceptor drum, the first tentative charging bias being preliminarily set corresponding to the target electric potential, and then forms a second toner image by an electric potential difference between the second electric potential region and the developing roller by controlling the developing bias applying unit to apply the target electric potential to the developing roller, and the image condition adjusting unit decides the value of the charging bias corresponding to the target electric potential from measurement results of print densities of the first toner image and the second toner image measured by the print density measurement unit.

2. The image forming apparatus according to claim 1, wherein, in the charging bias adjusting operation, when the print density of the first toner image is higher than the print density of the second toner image, the image condition adjusting unit decides a value smaller than the first tentative charging bias as the charging bias corresponding to the target electric potential, and when the print density of the first toner image is lower than the print density of the second toner image, the image condition adjusting unit decides a value larger than the first tentative charging bias as the charging bias corresponding to the target electric potential.

3. The image forming apparatus according to claim 1, wherein the exposure apparatus forms the first electric potential region by irradiating the first background-portion electric potential with the exposure light corresponding to a 100%-solid image.

4. The image forming apparatus according to claim 1, wherein the first electric potential is 0 V.

5. The image forming apparatus according to claim 1, wherein the first background-portion electric potential is set to be lower than the target electric potential.

6. The image forming apparatus according to claim 1, further comprising:

an environment detection unit that detects an ambient temperature or an ambient humidity, wherein, in the charging bias adjusting operation, the image condition adjusting unit preliminarily corrects the value of the first electric potential in response to the temperature or the humidity detected by the environment detection unit, and then forms the first toner image by applying the developing bias where the first differential electric potential is added to the first electric potential.

7. The image forming apparatus according to claim 1, further comprising:

an environment detection unit that detects an ambient temperature or an ambient humidity, wherein, in the charging bias adjusting operation, the image condition adjusting unit decides the value of the charging bias corresponding to the target electric potential from measurement results of the print densities of the first toner image and the second toner image measured by the print density measurement unit, and further decides the final value of the charging bias corresponding to the target electric potential after correcting the value of the decided charging bias in response to the temperature or the humidity detected by the environment detection unit.

8. The image forming apparatus according to claim 1, further comprising:

a count unit that counts an accumulated count of printed sheets on which the toner images are transferred or an accumulated operating time of the photoreceptor drum, wherein, in the charging bias adjusting operation, the image condition adjusting unit preliminarily corrects the value of the first electric potential in response to a count result of the count unit, and then forms the first toner image by applying the developing bias where the first differential electric potential is added to the first electric potential.

9. The image forming apparatus according to claim 1, further comprising:

a count unit that counts an accumulated count of printed sheets on which the toner images are transferred or an accumulated operating time of the photoreceptor drum, wherein, in the charging bias adjusting operation, the image condition adjusting unit decides the value of the charging bias corresponding to the target electric potential from the measurement results of the print densities of the first toner image and the second toner image measured by the print density measurement unit, and further decides the final value of the charging bias corresponding to the target electric potential after correcting the value of the decided charging bias in response to the count result of the count unit.

10. The image forming apparatus according to claim 1, wherein the image condition adjusting unit further executes a calibration operation for adjusting the print density of the toner image, and the formation of the first toner image and the measurement of the print density of the first toner image by the print density measurement unit are included in the calibration operation.

11. The image forming apparatus according to claim 1, wherein the formation of the first toner image and the measurement of the print density of the first toner image by the print density measurement unit in the calibration operation is executed with respect to the plurality of first electric potential regions where the values of the first electric potentials are mutually different.

12. The image forming apparatus according to claim 1, wherein the image condition adjusting unit further executes the calibration operation for adjusting the print density of the toner image prior to the charging bias adjusting operation and derives a relational expression of the electric potential difference between the surface potential of the photoreceptor drum and the developing roller, and the print density of the toner image through the calibration operation, and the image condition adjusting unit, in the charging bias adjusting operation, decides the value of the charging bias corresponding to the target electric potential from the measurement results of the print densities of the first toner image and the second toner image measured by the print density measurement unit, by referring to the relational expression.

13. An image forming apparatus comprising:

an apparatus main body;

a photoreceptor drum that has a circumference surface on which an electrostatic latent image including a background portion and an image portion is formed, the photoreceptor drum being rotationally driven in a predetermined rotation direction;

a charging apparatus arranged in contact with or close to the circumference surface of the photoreceptor drum, the charging apparatus charging the circumference surface at a predetermined electric potential;

an exposure apparatus that irradiates the circumference surface of the photoreceptor drum with an exposure light to form the electrostatic latent image, the circumference surface of the photoreceptor drum being charged at the predetermined electric potential;

a developing device that includes a developing roller opposed to the photoreceptor drum, the developing device supplying the photoreceptor drum with toner to develop the electrostatic latent image into a toner image;

a charging bias applying unit that applies a predetermined charging bias to the charging apparatus;

a developing bias applying unit that applies a predetermined developing bias to the developing roller;

an image condition adjusting unit that performs a charging bias adjusting operation, the charging bias adjusting operation adjusting an electric potential in the background portion in the electrostatic latent image on the photoreceptor drum to a predetermined target electric potential; and a print density measurement unit that measures a print density of the toner image, wherein, in the charging bias adjusting operation, the image condition adjusting unit forms a first electric potential region formed of a first electric potential by controlling the charging bias applying unit to charge the circumference surface of the photoreceptor drum to a first background-portion electric potential and then controlling the exposure apparatus to irradiate the circumference surface with the exposure light, and then forms a first toner image by an electric potential difference between the first electric potential region and the developing roller, by controlling the developing bias applying unit to apply the developing bias where a preliminarily set first differential electric potential is added to the first electric potential with respect to the developing roller, and the image condition adjusting unit forms a second electric potential region by controlling the charging bias applying unit to apply the charging bias where the first differential electric potential and a preliminarily set second differential electric potential are subtracted from a first tentative charging bias on the circumference surface of the photoreceptor drum, the first tentative charging bias being preliminarily set corresponding to the target electric potential, and then forms a second toner image by an electric potential difference between the second electric potential region and the developing roller by controlling the developing bias applying unit to apply the developing bias where the set second differential electric potential is subtracted from the target electric potential to the developing roller, and the image condition adjusting unit decides the value of the charging bias corresponding to the target electric potential from measurement results of print densities of the first toner image and the second toner image measured by the print density measurement unit.

* * * * *